United States Patent [19]

Stephenson

[11] Patent Number: 4,909,233

[45] Date of Patent: Mar. 20, 1990

[54] ADJUSTABLE THREADED NOCK REST FOR ARCHERY

[76] Inventor: William R. Stephenson, 519 Sixth St. South, Nampa, Id. 83651

[21] Appl. No.: 306,087

[22] Filed: Feb. 3, 1989

[51] Int. Cl.[4] ..... F41B 5/00

[52] U.S. Cl. ..... 124/91

[58] Field of Search ..... 124/23 R, 24 R, 86, 124/90, 91

[56] References Cited

U.S. PATENT DOCUMENTS

| | | | |
|---|---|---|---|
| 2,777,437 | 1/1957 | Allen . | |
| 2,910,058 | 10/1959 | Bender | 124/91 |
| 3,010,447 | 11/1961 | Roemer . | |
| 3,331,720 | 7/1967 | Watson . | |
| 3,340,862 | 9/1967 | Saunders | 124/91 |
| 3,375,815 | 4/1968 | Novak | 124/91 X |
| 3,756,215 | 9/1973 | Black . | |
| 3,937,205 | 2/1976 | Saunders . | |

FOREIGN PATENT DOCUMENTS

| | | | |
|---|---|---|---|
| 3405319 | 6/1984 | Fed. Rep. of Germany | 124/91 |

*Primary Examiner*—Randolph A. Reese
*Assistant Examiner*—John A. Ricci
*Attorney, Agent, or Firm*—Frank J. Dykas; Craig M. Korfanta

[57] ABSTRACT

An adjustable threaded nock set (10) having a pair of serving nuts (11) and (12) having longitudinal bores therethrough. Each bore is threaded to engage monofilament serving (5) of bow string (4). Nuts (11) and (12) are installed onto serving (5) and tightened together at the proper location in a lock nut arrangement.

20 Claims, 5 Drawing Sheets

ADJUSTABLE THREADED NOCK REST FOR ARCHERY

DESCRIPTION

BACKGROUND OF THE INVENTION

1. Technical Field.

This invention generally relates to nocking devices for archery bow strings and in particular to an adjustable and retrofittable nock set for installation of an archer's bow string.

2. Background Art.

Over the years, numerous devices have been manufactured for installation on an archer's bow string to define a nocking point for positioning the nock of an arrow. Obviously, greater accuracy and arrow speed can be obtained by consistently marking the arrow at the same point on the bow string.

In the past, some of the nocking devices used hard elongated members, against which the archer could position his fingers and draw back the bow string. Typical of these devices are SAUNDERS, U.S. Pat. Nos. 3,937,205, BLACK, 3,756,215, WATSON, 3,331,720, and ROEMER, 3,010,447. The primary objective of the elongated nocking device is actually twofold. The first objective is to provide a consistent nocking point, and the second objective is to prevent the bow string from pinching the archer's fingers during the draw.

Besides not being the current trend among avid archers, the previously mentioned devices suffer some serious drawbacks. The most serious drawback of these devices is that they cannot be readjusted once installed, or if they can be readjusted they are subject to constant readjustment as they tend not to stay in one place during use. Additionally, with the exception of Roemer, all of the previously discussed prior art devices require the bow string to be removed for installation of the nocking device.

Watson also discusses an alternative embodiment which uses a small nock rest, without the finger guard assembly. However, like its finger guard counterpart, its location on the bow string cannot be readjusted once it has been installed.

ALLEN, U.S. Pat. No. 2,777,437, teaches a pair of beads made of resilient material and frictionally fitted on the bow string. Again, the beads tend not to stay in proper alignment as they are subject to movement during use.

The present trend among avid archers is to use a filament type bow string having a monofilament serving tightly wound around the center portion of the bow string, directly adjacent the nocking area. Most present day avid archers prefer not to use a rigid finger guard type nock set as they feel it reduces the performance of the bow.

What is needed is a small retrofittable, adjustable nock set which can be installed without restringing the bow and further an adjustable nock set which will not fall or vibrate out of position.

It is therefore an object of the present invention to provide a small, easily adjustable and retrofittable nock set which is both easy to install, easy to use, and is not subject to undesirable movement during use.

DISCLOSURE OF INVENTION

These and other objects are accomplished by a pair of serving nuts having a longitudinal bore therethrough which is threaded to engage the monofilament serving of the bow string. The nuts are installed onto the serving and tightened together at the proper location in a lock nut arrangement.

The serving nuts are generally cylindrical in shape and each consist of two halves. Each nut is divided along a plane containing the longitudinal bore axis. Registration pins and holes are provided on opposing halves to align the nut halves around the bow string and nylon serving. A coaxial groove circumscribes each nut's outer surface and is sized to engage a lock ring, provided to lock the two nut halves together around the nylon serving.

In this manner, the two serving lock nuts can be installed onto the bow string serving and then turned in opposite radial directions so as to converge upon one another in lock nut type engagement, with the lower serving nut providing the nock set for the nock of an arrow.

BEST MODE FOR CARRYING OUT INVENTION

Figure 1:
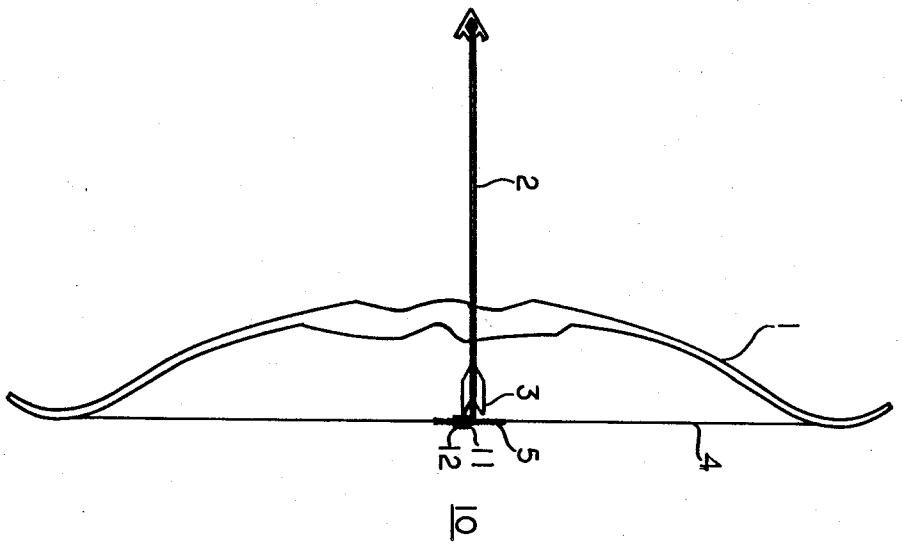
FIG. 1 is a representational view of a bow and arrow having an adjustable threaded nock set thereon.

An adjustable threaded nock set, which is retrofittable to a prestrung bow, is shown in FIG. 1 and generally designated as 10. Adjustable threaded nock set 10 is installed on monofilament serving 5 of bow string 4, which is attached to bow 1. The arrow nock 3 of arrow 2 engages serving 5 and rests on bottom of adjustable threaded nock set 10.

Figure 2:
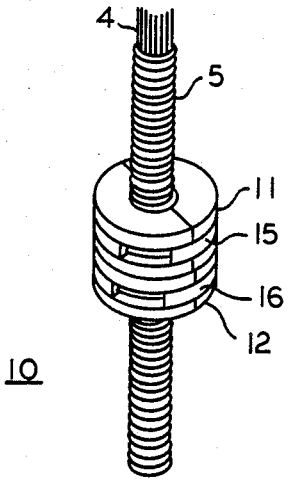
FIG. 2 is a representational view of an adjustable threaded nock set installed on the bow string serving.

FIG. 2 shows a detailed configuration of serving 5 and adjustable threaded nock set 10. Adjustable threaded nock set 10 generally has resilient plastic upper serving lock nut 11 and resilient plastic lower serving lock nut 12 threadedly engaged with serving 5 and rotatably engaged with each other in a lock nut fashion.

Figure 3:
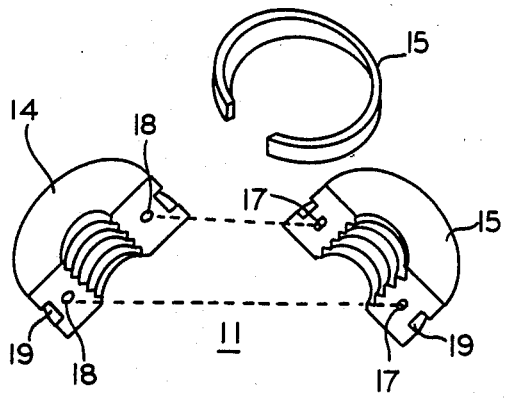
FIG. 3 is an exploded representational view of an upper serving lock nut.

Referring also now to FIG. 3, upper serving lock nut 11 is shown in an exploded representational view. Lower serving lock nut 12 which is shown in FIG. 2 is identical in configuration to upper serving lock nut 11. Upper serving lock nut 11 has two halves, upper nut first half 13 and upper nut second half 14. A registration means, which in this preferred embodiment consists of registration pins 17 and registration holes 18, is provided to align the nut halves together around the bow serving.

A coaxial lock ring groove 19 circumscribes the outer surfaces of upper nut first half 13 and upper nut second half 14. Lock ring groove 19 is sized to frictionally engage upper lock ring 15, thereby locking upper nut first half 13 and upper nut second half 14 together around the bow string and serving.

Upper lock ring 15 and lower lock ring 16 are, in this preferred embodiment, rings of resilient metal each having an open segment therein sized to allow the ring to slip over its corresponding serving lock nut and engage lock ring groove 19.

Figure 4:
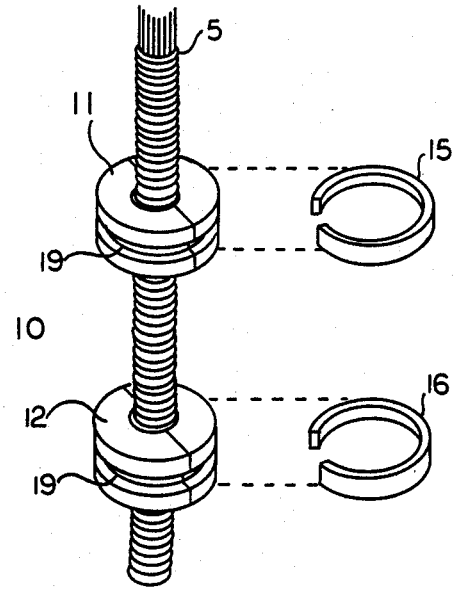
FIG. 4 is a partially exploded view of an adjustable threaded nock set installed on the bow string serving.

In use, referring now to FIG. 4, lower serving nut 12 is first installed around serving 5 and lower lock ring 16 is engaged in lock ring groove 19. Upper serving lock nut 11 is then installed on serving 5 and upper lock ring 15 is engaged with its corresponding lock ring groove 19. Lower serving lock nut 12 is then rotated up or down on serving 5 into the proper position and upper serving lock nut 11 is then engaged with lower serving lock nut 12 in a lock nut fashion to prevent adjustable threaded nock set 10 from moving up or down serving 5. The position of adjustable threaded nock set 10 can be changed if desired by simply disengaging upper serving lock nut 11 from lower serving lock nut 12 and repeating the above outlined steps.

Figure 5:
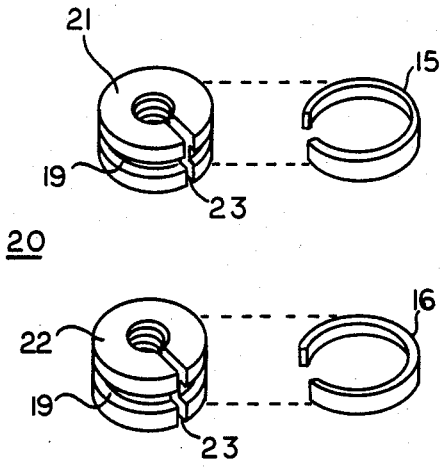
FIG. 5 is a partially exploded elevation view of a second embodiment of a threaded nock set assembly.

A second preferred embodiment is shown in FIG. 5 and consists of a one-piece threaded nut nock set assembly 20. One-piece threaded nut nock set assembly 20 has a pair of resilient plastic nuts, one-piece upper nut 21 and one-piece lower nut 22. Both upper nut 21 and lower nut 22 have a compression slot 23 disposed along a longitudinal side thereof. Additionally, both upper nut 21 and lower nut 22 have a threaded longitudinal bore therethrough for threadedly engaging a monofilament serving of a bow string. Upper and lower nut 21 and 22 each have a lock ring groove 19 coaxially disposed and circumcising their outer surfaces. Lock ring grooves 19 are each sized for receiving lock rings 15 and 16.

In use, one-piece upper nut 21 and one-piece lower nut 22 are slipped onto the serving of the bow string by forcing the bow string through compression slot 23. Upper lock ring 15 and lower lock ring 16 are then installed on their respective nuts. The nuts are then adjusted on the bow string serving in the same manner as is set forth in the first preferred embodiment.

While there is shown and described the present preferred embodiment of the invention, it is to be distinctly understood that this invention is not limited thereto but may be variously embodied to practice within the scope of the following claims.

I claim:

1. An adjustable threaded nock set for installation on the serving of a bow string, which comprises:

a pair of serving lock nuts each having two halves and a threaded longitudinal bore therethrough, sized to threadedly engage the bow string serving; and retaining means for retaining the two halves of each serving lock nut around the bow string serving.

2. The threaded nock set of claim 1 wherein said serving lock nuts each comprise a cylindrical form divided into two halves along a plane containing the longitudinal axis.

3. The threaded nock set of claim 2 wherein each half has a coaxial groove circumscribing its outer surface and being sized for receiving a lock ring.

4. The threaded nock set of claim 3 wherein said retaining means comprises:

registration means for aligning the nut halves one to the other around the bow string and serving: and a pair of lock rings each having a resilient ring having an open segment therein and being sized to engage and circumscribe the coaxial grooves of each serving lock nut.

5. The threaded nock set of claim 4 wherein said lock rings are manufactured of a resilient metal.

6. The threaded nock set of claim 5 wherein said serving lock nuts are composed of resilient plastic.

7. The threaded nock set of claim 4 wherein said serving lock nuts are composed of resilient plastic.

8. The threaded nock set of claim 3 wherein said serving lock nuts are composed of resilient plastic.

9. The threaded nock set of claim 2 wherein said serving lock nuts are composed of resilient plastic.

10. The threaded nock set of claim 1 wherein said serving lock nuts are composed of resilient plastic.

11. An adjustable threaded nock set for installation on the serving of a bow string which comprises:

a pair of plastic cylindrical serving lock nuts, each having a coaxial groove circumscribing its outer surface sized for receiving a lock ring, said serving lock nuts being further divided into two halves along a plane containing the longitudinal axis, said serving lock nuts further having a threaded bore therethrough coincident the longitudinal axis and sized for threaded engagement with the bow string serving;

registration means for aligning the nut halves one to the other around the bow string and serving; and a pair of lock rings, being resilient metal rings having an open segment therein and being sized to engage and circumscribe the coaxial grooves of each serving lock nut.

12. An adjustable threaded nock set for installation on the serving of the bow string, which comprises:

a pair of cylindrical serving lock nuts each having a longitudinal compression slot therein and a threaded longitudinal bore therethrough sized to threadedly engage the bow string serving; and retaining means for retaining each serving lock nut around the bow string serving.

13. The threaded nock set of claim 12 wherein each serving lock nut has a coaxial groove circumscribing its outer surface and being sized for receiving a lock ring.

14. The threaded nock set of claim 13 wherein said retaining means comprises a pair of lock rings each being a resilient ring having an open segment therein and being sized to engage and circumscribe the coaxial grooves of each serving lock nut.

15. The thraded nock set of claim 14 wherein said lock rings are manufactured of resilient metal.

16. The threaded nock set of claim 15 wherein said serving lock nuts are composed of resilient plastic.

17. The threaded nock set of claim 14 wherein said serving lock nuts are composed of resilient plastic.

18. The threaded nock set of claim 13 wherein said serving lock nuts are composed of resilient plastic.

19. The threaded nock set of claim 12 wherein said serving lock nuts are composed of resilient plastic.

20. An adjustable threaded nock set for installation on the serving of the bow string which comprises a pair of plastic cylindrical lock nuts, each having a coaxial groove circumscribing its outer surface sized for receiving a lock ring, said serving lock nuts further having a longitudinal compression slot disposed in one side and said serving lock nuts further having a threaded bore therethrough coincident the longitudinal axis and sized for threaded engagement with the bow string serving; and a pair of lock rings, being resilient metal rings and having an open segment therein and being sized to engage and circumscribe the coaxial groove of each serving lock nut.

* * * * *